United States Patent [19]

Norton

[11] 4,100,847

[45] Jul. 18, 1978

[54] CONVERTIBLE, LAMINAR FLOW BIOLOGICAL SAFETY CABINET APPARATUS

[75] Inventor: Robert O. Norton, Chesterfield, Mo.

[73] Assignee: Labconco Corporation, Kansas City, Mo.

[21] Appl. No.: 752,800

[22] Filed: Dec. 20, 1976

[51] Int. Cl.[2] ..... F23J 11/00

[52] U.S. Cl. ..... 98/115 LH; 98/36; 55/DIG. 18; 55/DIG. 29; 128/1 R

[58] Field of Search ..... 98/115 LH, 36; 55/DIG. 18, DIG. 29; 128/1 R; 23/292

[56] References Cited

U.S. PATENT DOCUMENTS

| | | | |
|---|---|---|---|
| 3,304,736 | 2/1967 | Brennan et al. | 98/36 |
| 3,363,539 | 1/1968 | Taylor et al. | 98/115 LH |
| 3,403,525 | 10/1968 | Beckwith et al. | 98/36 |
| 3,811,250 | 5/1974 | Fowler, Jr. | 55/DIG. 29 |

*Primary Examiner*—Ronald C. Capossela

*Attorney, Agent, or Firm*—Schmidt, Johnson, Hovey & Williams

[57] ABSTRACT

A laminar airflow biological safety cabinet apparatus is disclosed which is convertible by the user for changing the airflow pattern through the cabinet in order to meet different specialized conditions encountered in laboratory work with potentially hazardous biological specimens. Adjustable damper structure is provided adjacent the air outlet of the cabinet for simultaneously varying the amounts of air discharged and drawn into the cabinet, and the laminar flow of downwardly directed air through the work compartment thereof. An air filter is located immediately below the work surface of the cabinet and upstream of the air fan for removing contaminants from the air.

4 Claims, 4 Drawing Figures

CONVERTIBLE, LAMINAR FLOW BIOLOGICAL SAFETY CABINET APPARATUS

This invention relates to biological safety cabinet apparatus of the type used in laboratory work with potentially dangerous biological specimens. More particularly, it is concerned with such cabinet apparatus which is convertible by the user for altering the airflow pattern therewithin so that the cabinet can be modified to meet various safety standards required for handling different types of specimens. A prime feature of the invention pertains to the use of movable damper structure adjacent the air outlet of the cabinet for simultaneously varying the amounts of air discharged and introduced into the cabinet, and the laminar flow of air passing through the work compartment thereof.

Biological scientists concerned with laboratory safety have established a number of standards applicable to cabinets or hoods often used for experiments with potentially hazardous biological specimens. Such cabinets are normally provided with a partially or fully enclosed work compartment along with fan means for creating moving air currents within the cabinet. In many cases means are provided for creating laminar airflow through the work compartment of the hood, along with biological filtering elements interposed in the air path thereof for filtering contaminants. Cabinets of this type are designed to protect the worker from biological contamination, and just as importantly to protect the sample from human contamination. In general, cabinets of the above variety are grouped in classes (i.e., Class I, II or III), with various subclassifications or types within each broad class. A given cabinet is generally designed for use with particular types or classes of biological specimens having a known degree of hazard, and must meet the specialized performance standards established for safe work with such hazardous substances.

A prime drawback of prior safety hood or cabinet constructions stems from the fact that the airflow performance characteristics thereof cannot be altered. Thus, it has been necessary for many laboratories to buy and maintain various models of hoods for use with varying kinds of bilogical specimens, in order to meet the established safety requirements. As can be appreciated, this practice is uneconomical in that a number of relatively expensive cabinets must be purchased even if one or more of the same are used only infrequently.

Another problem encountered with certain prior biological cabinet constructions stems from the fact that substantially the entire interior and plenum thereof can become contaminated with biological substances. This results from location of the hood filter above the work compartment in spaced relationship to the hood blower unit. In such a cabinet, contaminated air flows through the blower and plenum and is not filtered until just prior to reentry through the work compartment; this construction not only has inherent dangers resulting from the relatively large contaminated area within the cabinet structure, but also makes cleanup and sterilization thereof a difficult task.

It is therefore the most important object of the present invention to provide a convertible biological safety cabinet apparatus which can be modified by the user in order to alter the airflow performance characteristics thereof to meet the established criteria for different classes of hazardous substances, so that a single unit can alternately be used for experimentation with biological substances requiring different airflow conditions and the like.

As a corollary to the foregoing, another object of the invention is to provide safety cabinet apparatus which includes movable damper structure strategically located adjacent the air discharge outlet thereof which can be moved for simultaneously varying the airflow pattern throughout the cabinet, including the respective amounts of air discharged from and drawn into the cabinet, and the laminar flow of air through the work compartment of the cabinet.

A still further object of the invention is to provide a convertible, laminar flow biological safety cabinet apparatus which includes filtering means located directly below the work compartment of the unit and upstream of the blower in order to minimize the area of contamination within the cabinet structure so that the danger of accidental contamination from the cabinet is minimized and cleanup and sterilization procedures are simplified.

Figure 1:
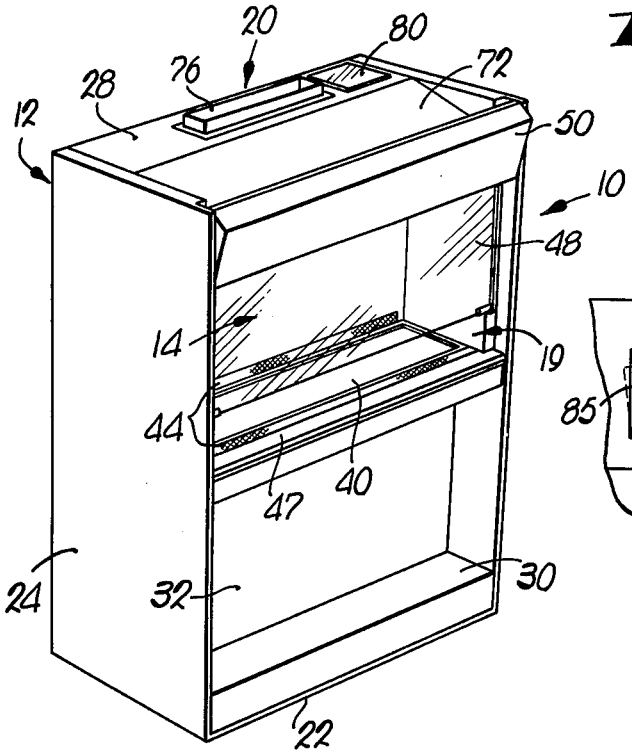
FIG. 1 is a perspective view of a convertible laminar flow biological safety cabinet in accordance with the invention.

Safety cabinet apparatus 10 broadly includes an upright, box-like frame or cabinet structure 12, a work compartment 14, fan means 16 for creating a moving pattern of air throughout apparatus 10, air filtering means 17 directly above fan means 16, and structure broadly referred to by the numeral 18 for defining an air path allowing continuous recirculation of air through apparatus 10 in a manner to be explained hereinafter. In addition, an air inlet 19, an air discharge outlet 20, and dampering means 21 are also provided.

In more detail, cabinet structure 12 includes a base 22, an upright back wall 23, side-by-side inner and outer sidewalls 24 and 26, and an apertured top wall 28. An elongated, rectangular, generally horizontally extending foot rest 30 is provided across the front of apparatus 10, along with a vertical, removably mounted access panel 32 which is recessed as shown in order to provide a knee well for facilitating work in cabinet 14 in a seated position. A fan housing 33 is defined by sidewalls 26, panel 32 and back wall 23, and a filter-receiving passageway 34 provided above housing 33 between irregular wall 35 and back wall 23. As shown, passageway 34 communicates with housing 33.

Figure 3:
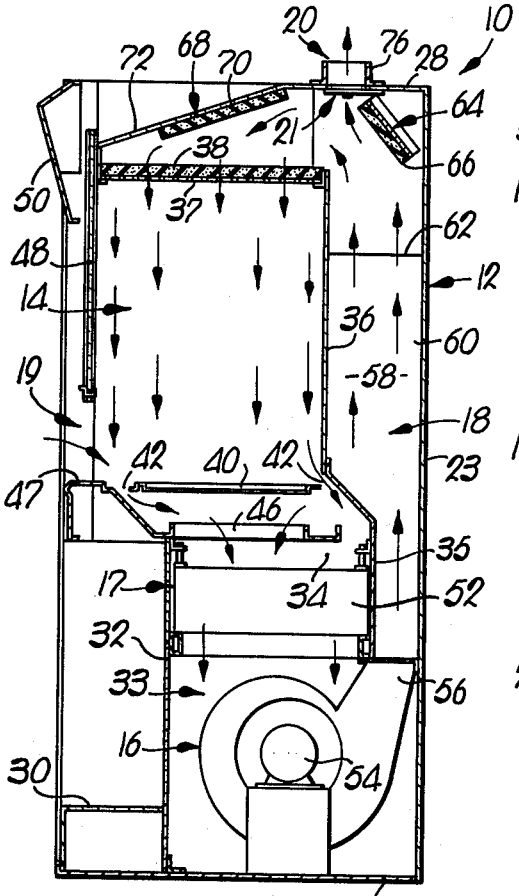
FIG. 3 is a vertical sectional view taken along irregular line 3—3 of FIG. 2 and further depicting the internal construction of the cabinet.

Work compartment 14 is defined by the respective inner sidewalls 26 along with a vertical liner 36 interconnected between the walls 26 and in spaced relationship to back wall 23 (see FIG. 3). In addition, cabinet 14 includes an apertured top plate 37 and a foraminous air diffuser 38 which serves to create a laminar, downwardly directed flow of air through compartment 14. A generally horizontally extending tray 40 presenting a work surface is located across the bottom of compartment 14 and is supported by means (not shown) secured to the inner sidewalls 26. A pair of elongated drainage openings 42 are provided along the front and back of tray 40 and are covered by respective lengths of perforated steel. A continuous, circumscribing drainage collection gutter 46 is located below tray 40 in disposition to catch any liquid or the like overflowing the tray, in order to prevent such liquid from contaminating the remainder of apparatus 10. A stainless steel counter section 47 is provided adjacent the forward edge of compartment 14 at approximately the same level as tray 40.

A vertically shiftable safety glass panel 48 is disposed across the front of compartment 14. Movement of panel 48 is facilitated by means of a pair of conventional counterbalancing sash weights (not shown) disposed between inner and outer sidewalls 26. The space between the lower edge of panel 48 and counter 47 defines fresh air inlet 19 adjacent tray 40, and allows worker access to the latter. Finally, a transversely extending reflector 50 having a florescent light (not shown) therein is provided adjacent the top of compartment 14 for illuminating the interior of the latter.

A pair of filtering elements 52 are located in side-by-side disposition directly below compartment 14 within passageway 34 in order to filter all air coming from the latter prior to recirculation thereof through apparatus 10. In this connection it will be noted that the filtering elements are disposed immediately below tray 40 and gutter 46 so that the area of possible contamination before filtering is minimized.

Figure 2:
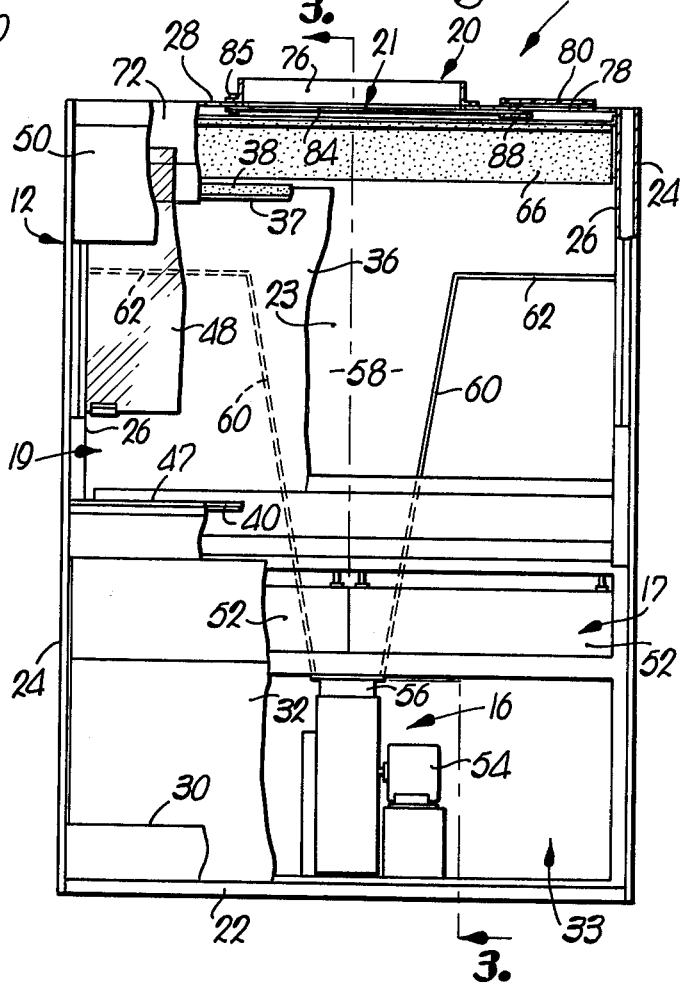
FIG. 2 is a front elevational view of the cabinet with parts broken away for clarity and illustrating the internal construction of the cabinet.

Fan means 16 is of conventional construction and includes a drive motor 54 coupled to a rotatable blower element. The outlet 56 of fan means 16 is directly coupled and in communication with a plenum chamber 58. Referring specifically to FIGS. 2 and 3, it will be seen that plenum 58 is defined by respective diverging sidewalls 60, horizontally extending walls 62 which are in spaced, parallel relationship to top wall 28, wall 35 and liner 36. Plenum 58 communicates with compartment 14 through diffuser 38 and plate 47, so that continuous air circulation path 18 is defined by plenum 58, compartment 14, passageway 34 and housing 33.

A first air-deflecting baffle 64 is obliquely disposed adjacent top wall 28 and includes a foraminous outermost section 66. Similarly, a second air-deflecting baffle 68 having a foraminous section 70 is located in oblique relationship generally above air diffuser 38. For this purpose, the forwardmost portion 72 of top wall 28 is inclined, and the section 70 is applied to the interior surface of portion 72.

Top wall 28 includes the generally rectangular air discharge opening 20 which is defined by upright circumscribing sidewall 76. In practice, a conventional exhaust duct (not shown) is coupled to wall 76 so that the outlet from apparatus 10 can be discharged to the atmosphere. A square damper access opening 78 is also provided in top wall 28 and is provided with a removable transparent cover 80.

Figure 4:
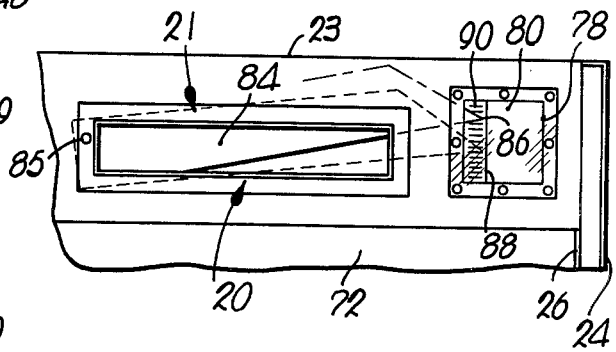
FIG. 4 is a fragmentary plan view of the airflowregulating damper provided with the cabinet, with the operation of the damper being illustrated in phantom.

Movable damper means 21 in the form of a pivotal plate 84 is disposed adjacent outlet opening 74. As best seen in FIG. 4, plate 84 is pivotally mounted at 85 and has a pointed end 86. End 86 is slidably received within a complementary bracket 88 adjacent opening 78. The bottom wall of bracket 88 is provided with a series of rules or gradations 90 so that the position of plate 84 can be altered in known standard amounts.

In use, fan means 16 is energized in order to create a moving pattern of air through apparatus 10 along path 18. The flow of air follows the arrows depicted in FIG. 3, i.e., along a continuous path downwardly through compartment 14, passageway 34 and housing 33, and upwardly through plenum 58. In this connection, desirable laminar airflow through compartment 14 is assured by means of diffuser 38. Moreover, the airflow characteristics along path 18 are controlled by plate 84 so that a given amount of air per unit time is discharged through outlet 20 and drawn in through inlet 19. Of course, this also controls the downward laminar flow of air as well.

When it is desired to alter the airflow characteristics of apparatus 10, it is only necessary to remove cover 80 and shift plate 84 as needed, using the rules 90 as a guide. In the case where plate 84 is moved to open a greater portion of outlet 20, a greater portion of the air traveling through apparatus 10 will be discharged; as a consequence, more air will be drawn into the cabinet through opening 19 beneath panel 48, and the laminar flow of recirculated air through compartment 14 will be lessened. Conversely, when plate 84 is moved to close outlet 20 to a greater extent, the opposite occurs and less air is drawn into apparatus 10 and laminar airflow is increased. Hence, apparatus 10 can be modified by the user to provide the necessary operational characteristics required for a given experiment or the like.

It will thus be seen that the safety cabinet apparatus of the present invention is convertible in order to vary the airflow pattern therewithin as desired. The particular cabinet disclosed herein is of the Class II variety, and damper means 82 allows the cabinet to be converted between a Type I and Type II, Class II hood. Of couse, the principles of the present invention can also be employed in other classes of cabinets or the like in order to achieve this desirable convertibility.

Having thus described the invention, what is claimed as new and desired to be secured by Letters Patent is:

1. Biological safety cabinet apparatus, comprising:

upright cabinet structure including means defining a continuous air path allowing recirculation of air within the cabinet structure, a work compartment defining a portion of said path and located and arranged for generally vertical, downwardly directed airflow therethrough, a fresh air inlet communicating directly with said compartment, and an air discharge outlet;

means presenting a generally horizontally disposed work surface positioned within said compartment and adjacent said air inlet;

filter means located directly beneath said work surface for removing contaminants from air traveling along said path and preventing discharge of said contaminants through said outlet;

fan means below said filter means for pulling ambient air into said air path through said inlet and moving air along said path;

air diffuser means above said work surface and located in said air path for creating generally vertical laminar flow of air throughout the entirety of said compartment; and movable damper means adjacent said outlet for simultaneously varying the amount of air discharged from the outlet, the amount of fresh air introduced through said inlet, and the laminar flow characteristics of the air traveling through said compartment.

2. Biological safety cabinet apparatus as set forth in claim 1 wherein said damper means includes a pivotal plate in at least partial covering relationship to said air discharge outlet.

3. Biological safety cabinet apparatus as set forth in claim 1 wherein said air diffuser means includes a foraminous diffuser located in said air path above said work surface.

4. Biological safety cabinet apparatus as set forth in claim 3 including air-deflecting means located above said diffuser for directing air currents through the latter.

* * * * *